US006618863B2

(12) United States Patent
Blechman

(10) Patent No.: US 6,618,863 B2
(45) **Date of Patent: *Sep. 16, 2003**

(54) CLOTHING

(76) Inventor: Bernard Mark Hardy Blechman, 130 Kingsland Road, London (GB), E2 8DP ( * ) Notice: Subject to any disclaimer, the term of this patent is extended or adjusted under 35 U.S.C. 154(b) by 0 days.

This patent is subject to a terminal disclaimer.

(21) Appl. No.: 09/765,087

(22) Filed: Jan. 18, 2001

(65) Prior Publication Data

US 2002/0029407 A1 Mar. 14, 2002

(30) Foreign Application Priority Data

Jan. 21, 2000 (GB) ..... 0001485

(51) Int. Cl.[7] ..... A41F 9/00
(52) U.S. Cl. ..... 2/311; 2/235; 2/236; 2/237; 2/108
(58) Field of Search ..... 2/311, 312, 321, 2/270, 341, 171.4, 183, 175.7, 76, 221, 236, 237, 195.4, 209.11, 336, 115, 227, 269, 228, 113, 114, 125, 126, 108, 94, 95, 85

(56) References Cited

U.S. PATENT DOCUMENTS

| | | | | |
|---|---|---|---|---|
| 898,511 A | * | 9/1908 | Schneider | |
| 1,208,132 A | * | 12/1916 | Gaines | |
| 1,287,354 A | * | 12/1918 | Lavign | |
| 1,299,323 A | | 4/1919 | Schaefer et al. | 2/92 |
| 2,687,530 A | | 8/1954 | Farnum | 2/217 |
| 2,692,988 A | | 11/1954 | Rouse | 2/73 |
| 3,161,890 A | * | 12/1964 | Betz | 2/237 |
| 3,887,968 A | * | 6/1975 | Lynam | 24/266 |
| 4,164,044 A | * | 8/1979 | Holmes | 2/237 |
| 4,164,792 A | * | 8/1979 | Ito | 2/108 |
| 4,477,928 A | | 10/1984 | Graff | 2/221 |
| 4,773,101 A | | 9/1988 | Kapp et al. | 2/69 |
| 5,263,202 A | * | 11/1993 | Siberell | 2/336 |
| 5,299,323 A | | 4/1994 | Schaefer et al. | 2/93 |
| 5,367,709 A | | 11/1994 | Teasley | 2/69 |
| 5,375,266 A | * | 12/1994 | Crisco | 2/243.1 |
| 6,317,894 B1 | * | 11/2001 | Blechman | 2/269 |

FOREIGN PATENT DOCUMENTS

| | | |
|---|---|---|
| GB | 1034796 | 7/1966 |
| GB | 2155761 | 10/1985 |
| JP | 53122454 | 9/1978 |

OTHER PUBLICATIONS

Patent Abstracts of Japan, vol. 1998, No. 10;Aug. 31, 1998,; JP 10 130922, May 19, 1998.

Patent Abstract of Japan, vol. 1999, No. 2, Feb. 26, 1999,; JP 10 310 918, Nov. 24, 1998.

* cited by examiner

*Primary Examiner*—John J. Calvert
*Assistant Examiner*—Alissa L Hoey
(74) *Attorney, Agent, or Firm*—Darby & Darby

(57) ABSTRACT

An item of clothing the width of a component part of which can be adjusted by the user, the clothing item having a line or cord (1) at least partly encircling the relevant part, which cord can be pulled by the wearer to adjust the width or tightness of the part by means of gathering of the material of the part around the line or cord. For the part of the circumference of the relevant part the cord is concealed under the material but emerges at a desired point and them passes again to the inside of the item of clothing so as to form a cord pull section (6) on the inside of the clothing. The clothing item includes means (5) for holding the component part in its tightened or gathered condition about the cord, the cord pull section (6) being used by the wearer for adjustment of the width of the relevant part.

14 Claims, 3 Drawing Sheets

CLOTHING

BACKGROUND OF THE INVENTION

1. Field of the Invention

The present invention relates to an item of clothing the width of a component part of which—e.g. waist, leg or sleeve—can be adjusted by the wearer.

2. Description of Related Art

It is commonplace for the waists of trousers or skirts to be reduced in width, i.e. tightened, by the user adjusting a belt. The waist of some trousers, for example jogging pants, is often adjusted by means of a cord passing around the waist. It is also known for the bottom of the legs of trousers in some cases to be gathered around the user's ankle.

There is perceived an outstanding need for a system which allows the width or tightness of the waist, leg or sleeve of an item of clothing to be varied in a convenient, stylish and easy manner.

SUMMARY OF THE INVENTION

Accordingly, the present invention provides an item of clothing the width of a component part of which can be adjusted by the user, the clothing item having a line or cord at last partly encircling the relevant part, which cord can be pulled by the wearer to adjust the width or tightness of the part by means of gathering of the material of the part on a shortened length of cord, wherein for part of the circumference of the relevant part the cord is concealed under the material but emerges at a desired point and then passes again to the inside of the item of clothing so as to form an exposed cord section on the outside of the clothing and a cord pull section on the inside of the clothing, the clothing item including means provided at the exposed cord section for holding the component part in its tightened condition on the cord and the cord pull section being used by the wearer for adjustment of the width of the relevant part.

It will thus be understood that any excess length of the cord, after the clothing part is tightened around the shortened length of cord, will always be on the inside of the clothing item. This is advantageous both from an aesthetic and a practical point of view. Where the cord is provided at the waist of the clothing item, for example a pair of trousers or a skirt, the cord pull section preferably is arranged inside a pocket of the clothing item, so that the wearer adjusts the waist by pulling the cord from inside the pocket.

Preferably the locking means is a conventional cord lock which is depressed when it is desired to pull the cord through, release of the cord lock then gripping the cord in the shortened position about the waist, leg or sleeve of the garment. However, use of such a cord lock is not essential. It would be possible for the contact surfaces between the cord and the material of the clothing to be such that the material of the clothing could be gathered and be adequately gripped around the cord only by means of friction. This arrangement is less preferred to one where there is a specific locking means locking member activated by the wearer to release the cord and then lock on the cord again.

Preferably, the cord is elasticated and a cord lock is provided at both sides of the fly or zip of the garment, in particular trousers.

As already indicated, the invention can in particular be used to adjust the waist of trousers or skirts. However, the invention can also be used to adjust the width of the ends of sleeves or trouser legs, so as to gather the material at that point about the leg or arm. This adjustment of the arms and legs of a clothing item may be presented as an enhancement of the style and look of the garment, so that the invention is both a practical means of adjusting a garment and can also be seen as a fashion accessory to increase the desirability and value of the clothing item.

It will of course be understood that the uses to which the invention can be put described above, i.e. at the waist arm or leg of a garment, are not exhaustive and persons working in the clothing industry will recognise that other clothing parts could be adjusted in the same way.

BRIEF DESCRIPTION OF THE DRAWINGS

Embodiments of the invention are described below, with reference to the accompanying drawings, wherein

FIG. 1 shows part of a pair of trousers, with a cord 1 encircling the waist 2 of the trousers. For most are the circumference of the waist the cord 1 is located within the material of the waist. This concealed part of the cord is shaded. The cord can be elastic, if desired.

DETAILED DESCRIPTION OF EMBODIMENTS OF THE INVENTION

Figure 1:
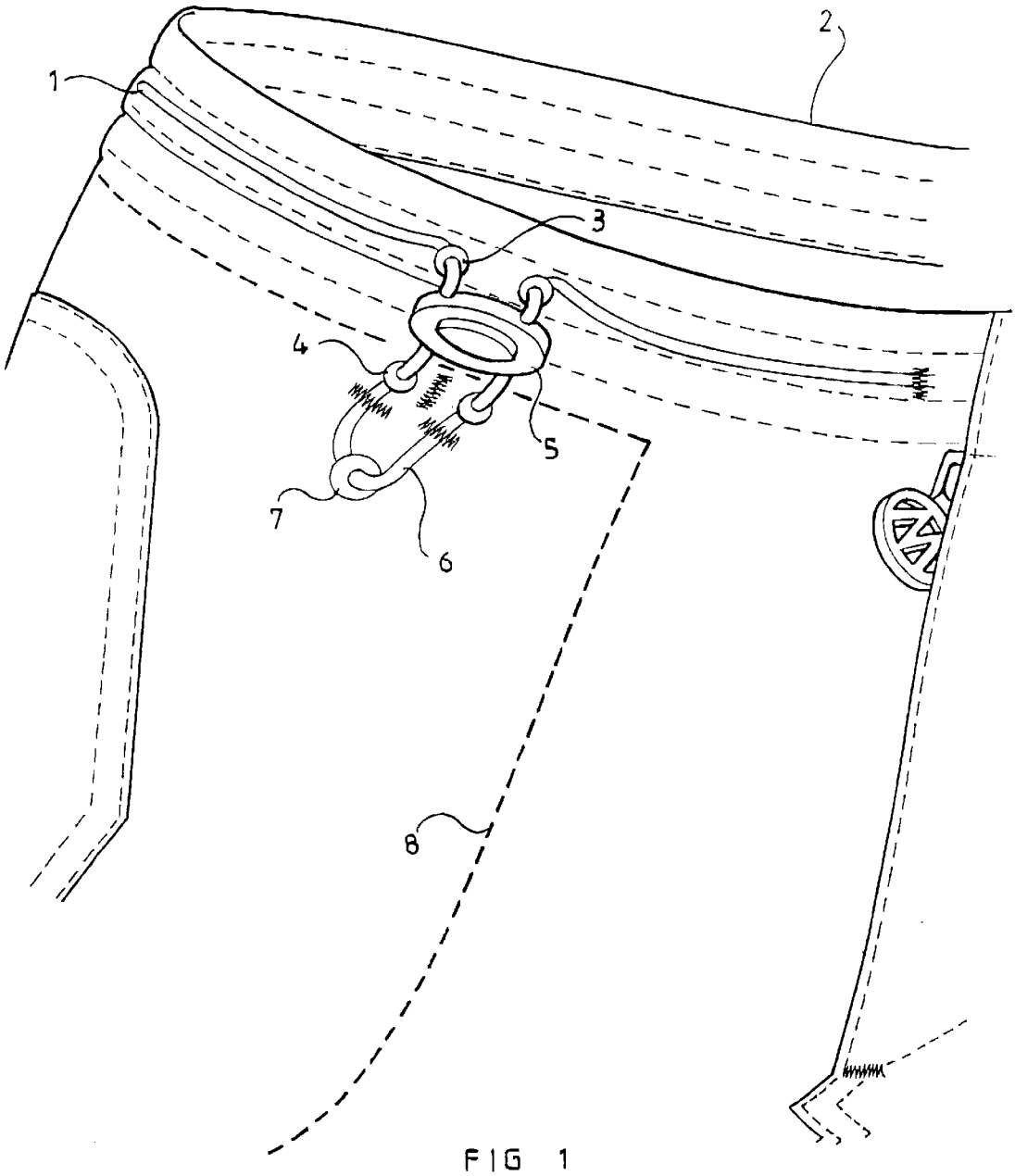
FIG. 1 is a perspective view of the waist area of a pair of trousers in accordance with one embodiment of the invention.

At a convenient position, generally the front, a loop of the cord emerges from the garment and then goes again to the inside of the garment, through offset pairs of standard eyelets 3, 4. At this exposed part of the cord is provided a double cord lock 5. Such cord locks are conventional in the garment trade and work on the principle of an apertured body with a sprung plug slotted therein, the plug also having an aperture which can register with the aperture in the body. The spring between the body and the plug acts to force the plug in a direction out of the body and into a position in which the apertures do not properly register. Cooperating lips between the body and plug prevent the plug from coming fully out of the body. On manufacture of the garment, the cord is threaded through the cord lock. Depression of the plug and into the body brings the apertures into registration, so that the cord can easily slip through. However, when the wearer releases the plug, the apertures try and come out of registration, thereby clamping the cord. This clamping action can be increased by having a toothed surface on the inside of the apertures. On some cord locks, a set of double apertures is provided, so a pair of cords runs through and can be locked in the same cord lock.

The part of the cord which is arranged on the inside of the garment, adjacent the exposed part of the cord which has the cord lock which is on the outside of the garment, can be considered the cord pull section 6. If desired, this pull section can have a bead 7 or something similar arranged thereon to aid location and gripping by the wearer.

Conveniently, the pull section 6 is accessed by the wearer through a pocket 8, e.g., a conventional pocket located on and accessible from the outside of the garment, such as a pocket having an opening on the outside of the garment, the interior geometry of which is shown by the heavy dotted lines.

Thus, in order to adjust the waist of the trousers, it is only necessary for the wearer to place his or her hand in the pocket and pull on the part of the cord which is there, while at the same time releasing the locking means. When the waist is sufficiently tight, the pull section of the cord and the locking means are released. The extra length of the cord which has been pulled out of the waist is automatically hidden on the inside of the garment, in particular within the pocket. Needless to say loosening of the garment is achieved by the reverse operation, i.e. the cord lock is released and the waist is pulled so that the length of cord on the inside of the garment is reduced.

If the trousers have a fly, the cord will be stitched at either side of the fly, rather than going around the entire waist as in the case of jogging pants. The cord can emerge on both sides of the fly, so two cord locks are present. In an alternative embodiment, not illustrated, the cord is tightened by pulling one of its ends on the inside of the garment, so a cord lock for a single cord is used, rather than the illustrated double cord lock.

Figure 2:
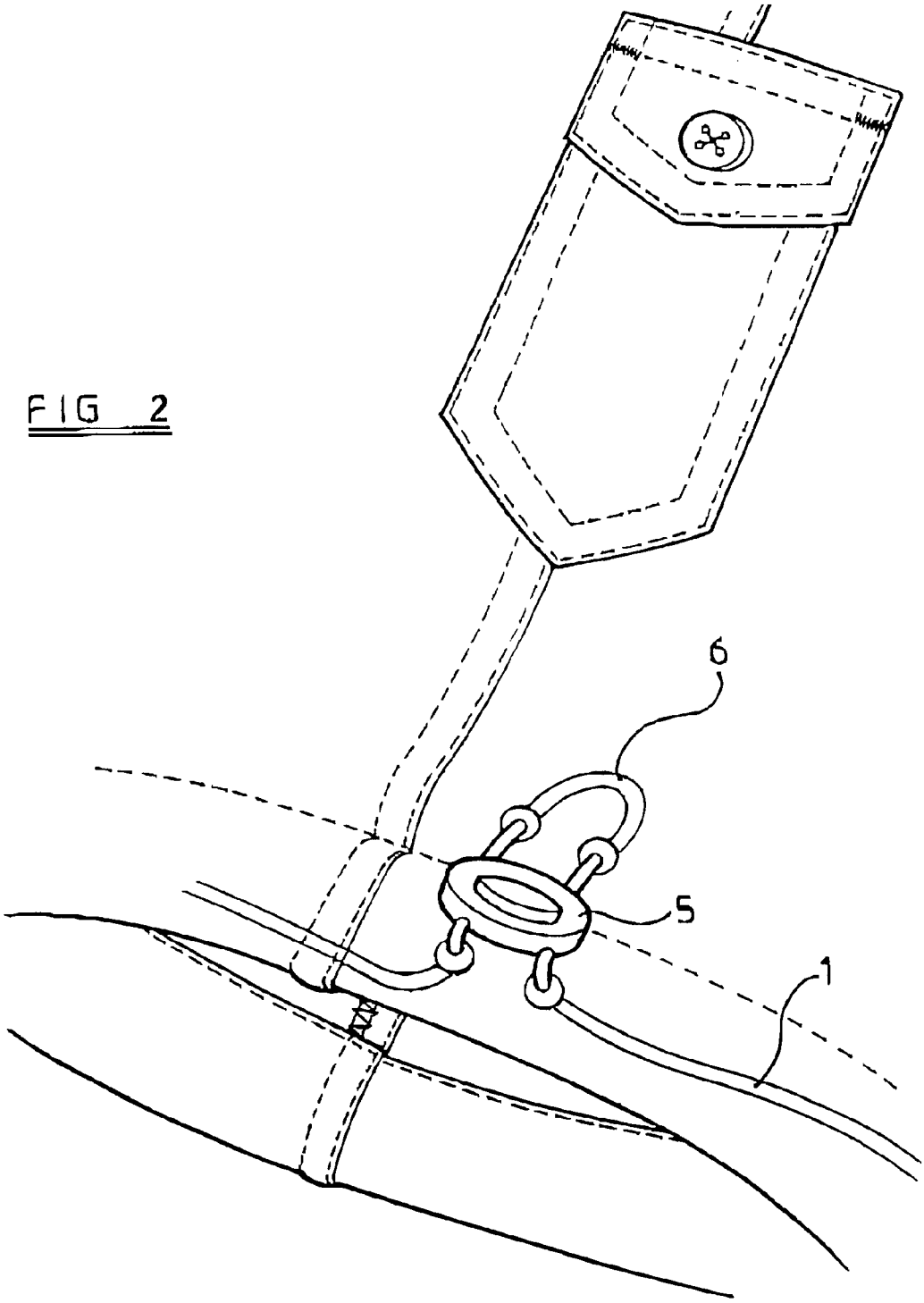
FIGS. 2 and 3 are perspective views of the end of a sleeve or trouser leg of an item of clothing in accordance with another embodiment of the invention.

FIG. 2 shows a cuff or trouser hem which is constructed in a similar fashion to the waist of the trousers of FIG. 1, though of course the circumference at the cuff or trouser leg will in practice be much less than that of the trouser waist. Again, there is a cord 1 encircling the cuff or hem, the cord being for the most part of the circumference concealed within a "tunnel" of material formed in a conventional fashion at the hem by stitching. The cord emerges from the cuff or hem and then passes again onto the inside of the garment, so as to form a cord pull section 6 which can be accessed by the wearer. A cord lock 5 is provided on the part of the cord which is exposed.

In this embodiment, a pocket will not generally be provided on the inside of the cuff or hem. Instead, the wearer will simply place his or her hand inside and pull the cord pull section 6 while releasing the cord lock 5 to gather the cuff or hem to the desired degree. Because the diameter of the cuff or hem will be far less than that of the waist of the garment, it is expected that the excess length of cord within the garment, after adjustment, will not be great and thus no problem will be caused by the fact that this excess length is not within a specific pocket. Of course, if desired, a pocket could be stitched on the inside of the cuff or hem to accommodate the extra length of cord, after adjustment.

For reasons of style, it is preferred that a pair of trousers has the above described cord systems at both waist and trouser hem locations.

Figure 3:
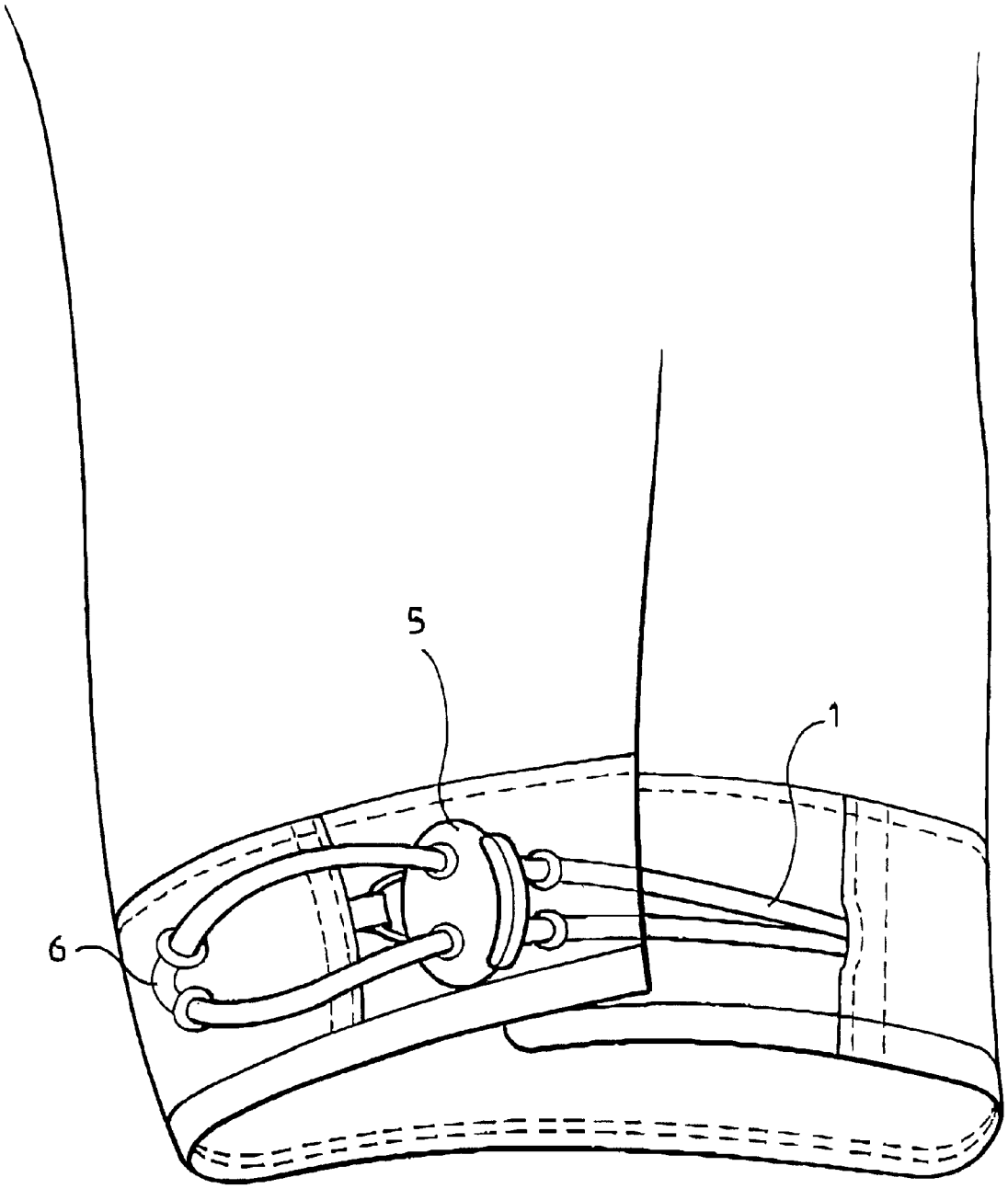

FIG. 3 shows the cuff of a sleeve of an item of clothing. The cord 1 is stitched to one flap of the cuff, passes under the other flap and emerges to form an exposed section where the cord lock 5 is fitted. The cord passes again to the inside of the cuff to form the cord pull section 6. As in the earlier embodiment, pulling the section 6 of cord while depressing the cord lock shortens the length of cord to the inside of the cord lock, in order to tighten the cuff.

Other uses of the cord system of the invention will be apparent to persons skilled in the art; only a few examples are specifically described here.

What is claimed is:

1. An item of clothing the width of a part of which can be adjusted by the user while wearing the item, the clothing item having a cord at least partly encircling the relevant part, which cord can be pulled by the wearer while wearing the item to adjust the width of the part by gathering material of the part on a shortened length of cord, wherein for part of the circumference of the relevant part the cord is concealed under the material but emerges at a desired point and then passes again to the inside of the item of clothing accessible to the user while wearing the item so as to form an exposed cord section on the outside of the clothing and a cord pull section on the inside of the clothing accessible to the user while wearing the item, the clothing item including means provided at the exposed cord section for holding the component part in its tightened condition on the cord and the cord pull section can be used by the wearer for adjustment of the width of the relevant part while wearing the item.

2. An item of clothing according to claim 1, wherein the cord is concealed under the material along a majority of the circumference of the clothing part.

3. An item of clothing according to claim 2, wherein the cord is provided at the waist of the clothing item and the cord pull section is arranged inside a pocket of the clothing item accessible to the user while wearing the item, so that the wearer can adjust the waist by pulling the cord from inside the pocket.

4. An item of clothing according to claim 3, wherein the cord is elasticated and a cord lock is provided at both sides of the fly of the item.

5. An item of clothing according to claim 1, wherein the cord is arranged at the ends of at least one of sleeves and legs of the clothing item.

6. An item of clothing according to claim 1, wherein the cord emerges at a desired point and then passes again to the inside of the item of clothing so as to form a loop of the cord, the loop comprising the exposed cord section and the cord section that is formed by a closed end of the loop.

7. An item of clothing according to claim 1, wherein the part can be adjusted by the user from the outside of the item.

8. An item of clothing the width of a part of which can be adjusted by the user while wearing the item, the clothing item having a cord at least partly encircling the relevant part, which cord can be pulled by the wearer while wearing the item to adjust the width of the part by gathering material of the part on a shortened length of cord, wherein for part of the circumference of the relevant part the cord is concealed under the material but emerges at a desired point and then passes again to the inside of the item of clothing accessible to the user while wearing the item so as to form an exposed cord section on the outside of the clothing and a cord pull section on the inside of the clothing accessible to the user while wearing the item, the clothing item including a cord holder provided at the exposed cord section for holding the component part in its tightened condition on the cord and the cord pull section can be used by the wearer for adjustment of the width of the relevant part while wearing the item.

9. An item of clothing according to claim 8, wherein the cord is provided at the waist of the clothing item and the cord pull section is arranged inside a pocket of the clothing item accessible to the user while wearing the item, so that the wearer can adjust the waist by pulling the cord from inside the pocket.

10. An item of clothing according to claim 8, wherein the part can be adjusted by the user from the outside of the item.

11. An item of clothing the width of a part of which can be adjusted by a user while wearing the item, comprising:

a pocket having a opening on the outside of the item accessible by a hand while the item is being worn;

a cord at least partly encircling the part, the cord being concealed under the material for a portion thereof, emerging at a desired point, and passing through the material into the pocket so as to form an exposed cord section on the outside of the item and a cord pull section on the inside of the pocket accessible to the user through the opening while wearing the item; and a cord holder provided at the exposed cord section;

wherein the item can be adjusted by the user pulling the cord pull section from inside the pocket to gather material of the part on a shortened length of cord, and the cord holder holds the part in its adjusted condition on the cord.

12. An item of clothing according to claim 11, wherein the cord is concealed under the material along a majority of the circumference of the part.

13. An item of clothing according to claim 11, wherein the cord is elasticized, and a cord lock is provided at both sides of a fly of the item.

14. An item of clothing according to claim 11, wherein the cord forms a loop comprising the exposed cord section and the cord pull section that is formed by a closed end of the loop.

* * * * *